US008387572B2

(12) United States Patent
Ulrey et al.

(10) Patent No.: US 8,387,572 B2
(45) Date of Patent: Mar. 5, 2013

(54) AUXILIARY PUMP SCHEME FOR A COOLING SYSTEM IN A HYBRID-ELECTRIC VEHICLE

(75) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 563 days.

(21) Appl. No.: 12/631,034

(22) Filed: Dec. 4, 2009

(65) Prior Publication Data

US 2011/0132291 A1 Jun. 9, 2011

(51) Int. Cl.
*F01P 5/10* (2006.01)

(52) U.S. Cl. ..... 123/41.44

(58) Field of Classification Search ..... None
See application file for complete search history.

(56) References Cited

U.S. PATENT DOCUMENTS 4,308,994 A * 1/1982 Perhats ..... 237/12.3 B
6,082,626 A * 7/2000 Morikawa et al. ..... 237/12.3 B
6,321,697 B1 11/2001 Matsuda et al.
6,928,962 B2 8/2005 Yamazaki
2008/0251303 A1 10/2008 Rouaud et al.
2008/0256949 A1 10/2008 Wikstrom et al.

FOREIGN PATENT DOCUMENTS

DE 102008000876 12/2008

OTHER PUBLICATIONS

2008185021JPA_TRANS.*

* cited by examiner

*Primary Examiner* — Lindsay Low
*Assistant Examiner* — Maria Aponte
(74) *Attorney, Agent, or Firm* — Julia Voutyras; Alleman Hall McCoy Russell & Tuttle LLP

(57) ABSTRACT

Various systems and methods are described for a cooling system coupled to an engine in a vehicle. One example method comprises, during engine off, operating an auxiliary pump to flow coolant through a heater core; and, during engine running, operating an engine pump to flow coolant through the heater core and radiator, and selectively operating the auxiliary pump to assist flow through the heater core based on operating conditions.

15 Claims, 4 Drawing Sheets

AUXILIARY PUMP SCHEME FOR A COOLING SYSTEM IN A HYBRID-ELECTRIC VEHICLE

TECHNICAL FIELD

The present application relates generally to a cooling system coupled to an engine in a motor vehicle.

BACKGROUND AND SUMMARY

A cooling system coupled to an engine utilizes an engine-driven pump to circulate coolant for cooling components of the engine in addition to providing heat to a passenger compartment of a vehicle. In hybrid-electric vehicles, an electric auxiliary pump may be included in the system in order to continue heating the passenger compartment during occasions when the engine is off; however, the auxiliary pump is not operated while the engine is running.

One example in which an auxiliary pump is used with an engine-driven pump while the engine is running is disclosed in US Patent Application Publication 2008/0251303. In the cited reference, a high temperature cooling circuit includes an engine-driven water pump and a low temperature cooling circuit includes an electric water pump. Under selected operating conditions, the high temperature and low temperature circuits may be in fluidic communication; however, only one of the two water pumps may be operational. One example in which the water pumps are both operational while the cooling circuits are in fluidic communication is during a cold start of the engine. Once the temperature of the engine rises, however, both pumps remain operational but the cooling circuits operate without fluidic communication between them in order to maintain the lower temperature of the low temperature cooling circuit. As such, the engine-driven pump maintains a high output and does not receive assistance from the electric pump, and still must be sized sufficiently to pump enough flow to manage engine temperatures under continuous heavy engine loads.

The inventors herein have recognized the above issues and have devised an approach to at least partially address them. In one example, a method for a cooling system coupled to an engine in a vehicle is disclosed. The method comprises, during engine off, operating an auxiliary pump to flow coolant through a heater core, and, during engine running, operating an engine pump to flow coolant through the heater core and radiator, and selectively operating the auxiliary pump to assist the flow through the heater core based on operating conditions.

For example, under conditions in which the engine is running and the engine temperature is greater than a threshold temperature, the auxiliary pump may be activated in order to assist the operation of the engine-driven pump in managing engine temperature. In this manner, the power required to operate the engine-driven pump may be maintained at a lower value when less cooling is needed. Furthermore, the engine-driven pump may be downsized due to its lowered output when the auxiliary pump is used while the engine is running and the engine temperature is high.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to a method for operating an electric auxiliary water pump to assist an engine-driven water pump during selected operating conditions while the engine is running in a vehicle with a hybrid-electric propulsion system. The auxiliary pump may be operated while the engine is off and the vehicle is still in operation (e.g., an electric only mode of the hybrid-electric vehicle) in order to circulate coolant through the heater core and supply heat to a passenger compartment of the vehicle. Additionally, the auxiliary pump may be operated while the engine is running. For example, the auxiliary pump may be activated during engine operating conditions in which the engine temperature is above a threshold temperature. In such a configuration, the auxiliary pump may assist the operation of the engine-driven pump (e.g., during extended high engine loads in warm ambient conditions) and as a result less power may be required to operate the engine-driven pump. As such, the engine-drive pump may be downsized and fuel economy and engine efficiency may be increased.

Figure 1:
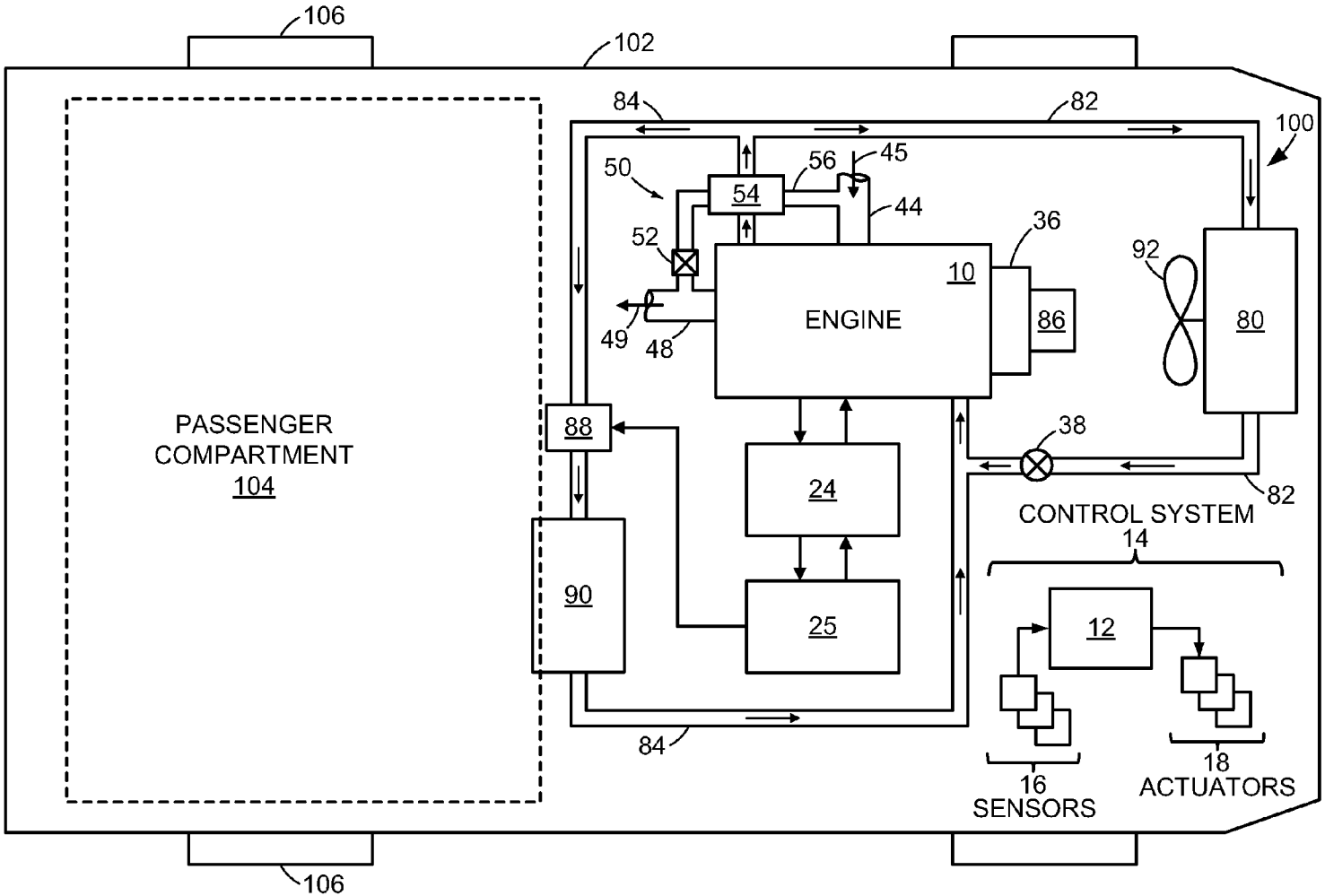
FIG. 1 shows a schematic diagram of an engine with a cooling system in a hybrid-electric vehicle.

Turning now to FIG. 1, an example embodiment of a cooling system 100 in a motor vehicle 102 is illustrated schematically. Cooling system 100 circulates coolant through internal combustion engine 10 and exhaust gas recirculation cooler (EGR) 54 to absorb waste heat and distributes the heated coolant to radiator 80 and/or heater core 90 via coolant lines 82 and 84, respectively.

In particular, FIG. 1 shows cooling system 100 coupled to engine 10 and circulating engine coolant from engine 10, through EGR cooler 54, and to radiator 80 via engine-driven water pump 86, and back to engine 10 via coolant line 82. Engine-driven water pump 86 may be coupled to the engine via front end accessory drive (FEAD) 36, and rotated proportionally to engine speed via belt, chain, etc. Specifically, engine-driven pump 86 circulates coolant through passages in the engine block, head, etc., to absorb engine heat, which is than transferred via the radiator 80 to ambient air. In an example where pump 86 is a centrifugal pump, the pressure (and resulting flow) produced may be proportional to the crankshaft speed, which in the example of FIG. 1, is directly proportional to engine speed. The temperature of the coolant may be regulated by a thermostat valve 38, located in the cooling line 82, which may be kept closed until the coolant reaches a threshold temperature.

Further, fan 92 may be coupled to radiator 80 in order to maintain an airflow through radiator 80 when vehicle 102 is moving slowly or stopped while the engine is running. In some examples, fan speed may be controlled by controller 12. Alternatively, fan 92 may be coupled to engine-driven water pump 86.

As shown in FIG. 1, engine 10 may include an exhaust gas recirculation (EGR) system 50. EGR system 50 may route a desired portion of exhaust gas from exhaust passage 48 to intake passage 44 via EGR passage 56. The amount of EGR provided to intake passage 44 may be varied by controller 12 via EGR valve 52. Further, an EGR sensor (not shown) may be arranged within EGR passage 56 and may provide an indication of one or more of pressure, temperature, and concentration of the exhaust gas. Alternatively, the EGR may be controlled based on an exhaust oxygen sensor and/or and intake oxygen sensor. Under some conditions, EGR system 50 may be used to regulate the temperature of the air and fuel mixture within the combustion chamber. EGR system 50 may further include EGR cooler 54 for cooling exhaust gas 49 being reintroduced to engine 10. In such an embodiment, coolant leaving engine 10 may be circulated through EGR cooler 54 before moving through coolant line 82 to radiator 80.

After passing through EGR cooler 54, coolant may flow through coolant line 82, as described above, and/or through coolant line 84 to heater core 90 where the heat may be transferred to passenger compartment 104, and the coolant flows back to engine 10. In some examples, engine-driven pump 86 may operate to circulate the coolant through both coolant lines 82 and 84. In other examples, such as the example of FIG. 1 in which vehicle 102 has a hybrid-electric propulsion system, an electric auxiliary pump 88 may be included in the cooling system in addition to the engine-driven pump. As such, auxiliary pump 88 may be employed to circulate coolant through heater core 90 during occasions when engine 10 is off (e.g., electric only operation) and/or to assist engine-driven pump 86 when the engine is running, as will be described in further detail below. Like engine-driven pump 86, auxiliary pump 88 may be a centrifugal pump; however, the pressure (and resulting flow) produced by pump 88 may be proportional to an amount of power supplied to the pump by energy storage device 25.

In this example embodiment, the hybrid propulsion system includes an energy conversion device 24, which may include a motor, a generator, among others and combinations thereof. The energy conversion device 24 is further shown coupled to an energy storage device 25, which may include a battery, a capacitor, a flywheel, a pressure vessel, etc. The energy conversion device may be operated to absorb energy from vehicle motion and/or the engine and convert the absorbed energy to an energy form suitable for storage by the energy storage device (e.g., provide a generator operation). The energy conversion device may also be operated to supply an output (power, work, torque, speed, etc.) to the drive wheels 106, engine 10 (e.g., provide a motor operation), auxiliary pump 88, etc. It should be appreciated that the energy conversion device may, in some embodiments, include only a motor, only a generator, or both a motor and generator, among various other components used for providing the appropriate conversion of energy between the energy storage device and the vehicle drive wheels and/or engine.

Hybrid-electric propulsion embodiments may include full hybrid systems, in which the vehicle can run on just the engine, just the energy conversion device (e.g., motor), or a combination of both. Assist or mild hybrid configurations may also be employed, in which the engine is the primary torque source, with the hybrid propulsion system acting to selectively deliver added torque, for example during tip-in or other conditions. Further still, starter/generator and/or smart alternator systems may also be used. Additionally, the various components described above may be controlled by vehicle controller 12 (described below).

From the above, it should be understood that the exemplary hybrid-electric propulsion system is capable of various modes of operation. In a full hybrid implementation, for example, the propulsion system may operate using energy conversion device 24 (e.g., an electric motor) as the only torque source propelling the vehicle. This "electric only" mode of operation may be employed during braking, low speeds, while stopped at traffic lights, etc. In another mode, engine 10 is turned on, and acts as the only torque source powering drive wheel 106. In still another mode, which may be referred to as an "assist" mode, the hybrid propulsion system may supplement and act in cooperation with the torque provided by engine 10. As indicated above, energy conversion device 24 may also operate in a generator mode, in which torque is absorbed from engine 10 and/or the transmission. Furthermore, energy conversion device 24 may act to augment or absorb torque during transitions of engine 10 between different combustion modes (e.g., during transitions between a spark ignition mode and a compression ignition mode).

FIG. 1 further shows a control system 14. Control system 14 may be communicatively coupled to various components of engine 10 to carry out the control routines and actions described herein. For example, as shown in FIG. 1, control system 14 may include an electronic digital controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 16, which may include user inputs and/or sensors (such as transmission gear position, gas pedal input, brake input, transmission selector position, vehicle speed, engine speed, mass airflow through the engine, ambient temperature, intake air temperature, etc.), cooling system sensors (such as coolant temperature, fan speed, passenger compartment temperature, ambient humidity, etc.), and others. Further, controller 12 may communicate with various actuators 18, which may include engine actuators (such as fuel injectors, an electronically controlled intake air throttle plate, spark plugs, etc.), cooling system actuators (such as air handling vents and/or diverter valves in the passenger compartment climate control system, etc.), and others. In some examples, the storage medium may be programmed with computer readable data representing instructions executable by the processor for performing the methods described below as well as other variants that are anticipated but not specifically listed.

As noted herein, the amount of waste heat transferred to the coolant from the engine may vary with operating conditions, thereby affecting the amount of heat transferred to the airflows. For example, as engine output torque, or fuel flow, is reduced, the amount of waste heat generated may be proportionally reduced. Such reduced output may be typical of idling conditions, which correspondingly also result in a relatively lower engine speed compared with driving operation, thus reducing coolant flow. During some conditions, such as low ambient temperature and extended idle operation, the reduced heat transfer to the coolant in combination with reduced coolant flow in the dual parallel loop configuration can result in insufficiently low temperature of airflow in the rear heating system.

Figure 2:
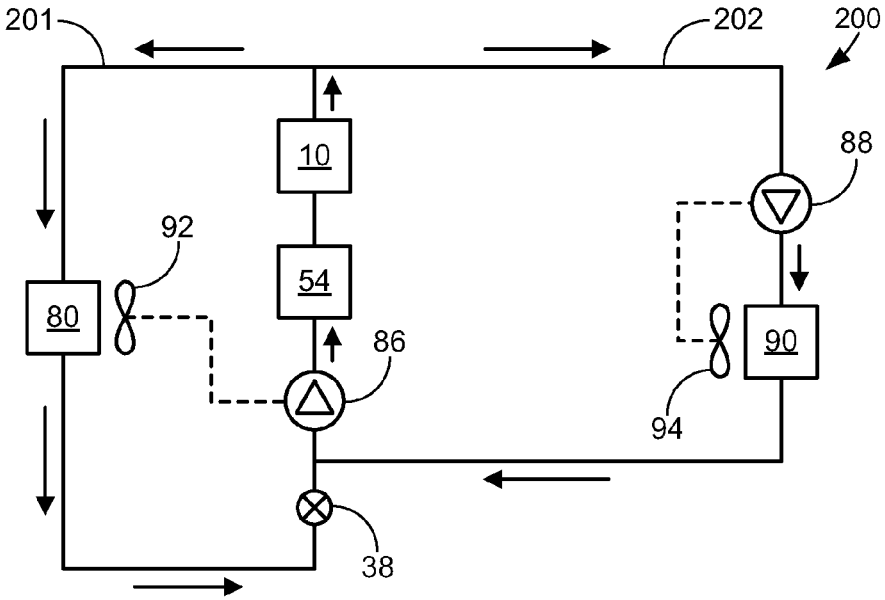
FIG. 2 shows a circuit diagram illustrating an embodiment of coolant flow through the cooling system.
Figure 3:
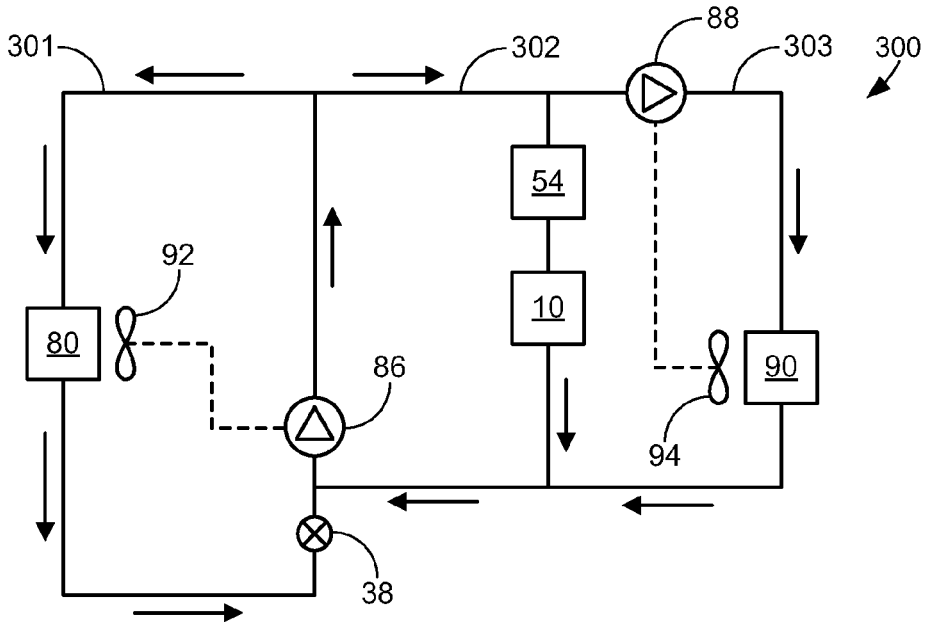
FIG. 3 shows a circuit diagram illustrating another embodiment of coolant flow through the cooling system.

Turning now to FIGS. 2 and 3, example embodiments of coolant flow circuits (e.g., cooling circuits) are illustrated. In the example of FIG. 2, coolant flow through the heater core may be assisted via an auxiliary pump. In the example of FIG. 3, an auxiliary pump is utilized to assist coolant flow through the engine and EGR cooler in addition to the heater core.

FIG. 2 shows an example embodiment of a cooling system similar to the embodiment depicted in FIG. 1. As depicted, cooling circuit 200 consists of two parallel loops 201 and 202 that are in fluidic communication and have a shared engine-driven water pump 86.

In loop 201, pump 86 operates to pump coolant through engine 10 and EGR cooler 54. From EGR cooler 54, coolant is circulated through radiator 80 and back to pump 86. As described above, the coolant may absorb heat from the engine and then pass through the radiator where it is cooled. As shown in FIG. 2 and described with reference to FIG. 1, cooling circuit 200 may include thermostat 38. Thermostat 38 may regulate the flow of coolant by remaining closed and blocking coolant flow to the radiator until a threshold coolant temperature is reached. In this manner, the engine may heat up faster. Further, fan 92 may be coupled to pump 86 (as shown in FIG. 1), where the fan 92 may be rotated at a speed proportional to the pump speed, such as a 1:1 speed ratio. In another example, as speed of pump 86 increases, speed of fan 92 may also be increased, and vice versa In loop 202 of FIG. 2, pump 86 operates to pump coolant through engine 10 and EGR cooler 54. After passing through EGR cooler 54, coolant is circulated through heater core 90 and back to pump 86. As shown in FIG. 2, loop 202 also includes an auxiliary water pump 88. Auxiliary pump 88 may be an electric pump that is operated during an electric only mode of hybrid vehicle operation. Additionally, auxiliary pump 88 may be operated selectively while the engine is running, such as when additional coolant flow enables the system to maintain or reduce engine temperature to within an acceptable range. Further, as shown in FIG. 2, heater core fan 94 may be coupled to auxiliary pump 88. Heater core fan 94 may be operated at a speed proportional to pump 88, such as a 1:1 speed ratio. In this manner, the auxiliary pump may assist the operation of the engine-driven pump 86, as will be described in greater detail with respect to FIGS. 4 and 5.

Moving on to FIG. 3, an alternative embodiment of a cooling circuit of a cooling system is shown. Cooling circuit 300 consists of three parallel loops 301, 302, and 303 in fluidic communication and with a shared engine-driven water pump 86 which may be coupled to fan 92, in a similar manner as in FIG. 2. Coolant may be circulated to loops 301, 302, and 303 via pump 86. Further, an auxiliary water pump 88 may be included in loop 302 such that coolant flow from pump 86 through loops 302 and 303 is assisted by auxiliary pump 88. As shown in the embodiment of FIG. 3, heater core fan 94 may be coupled to auxiliary pump 88, again in a manner similar to that of FIG. 2. Thus, coolant flow through engine 10, EGR cooler 54, and heater core 90 may be assisted by auxiliary pump 88 during selected operating conditions, as will be described in greater detail below.

In other embodiments, the cooling system may include a second auxiliary water pump. For example, in one configuration, an engine-driven pump may be utilized to circulate coolant through the radiator while one auxiliary pump is used to circulate coolant within the engine and EGR cooler and a second auxiliary pump is used to circulate coolant through the heater core.

Figure 4:
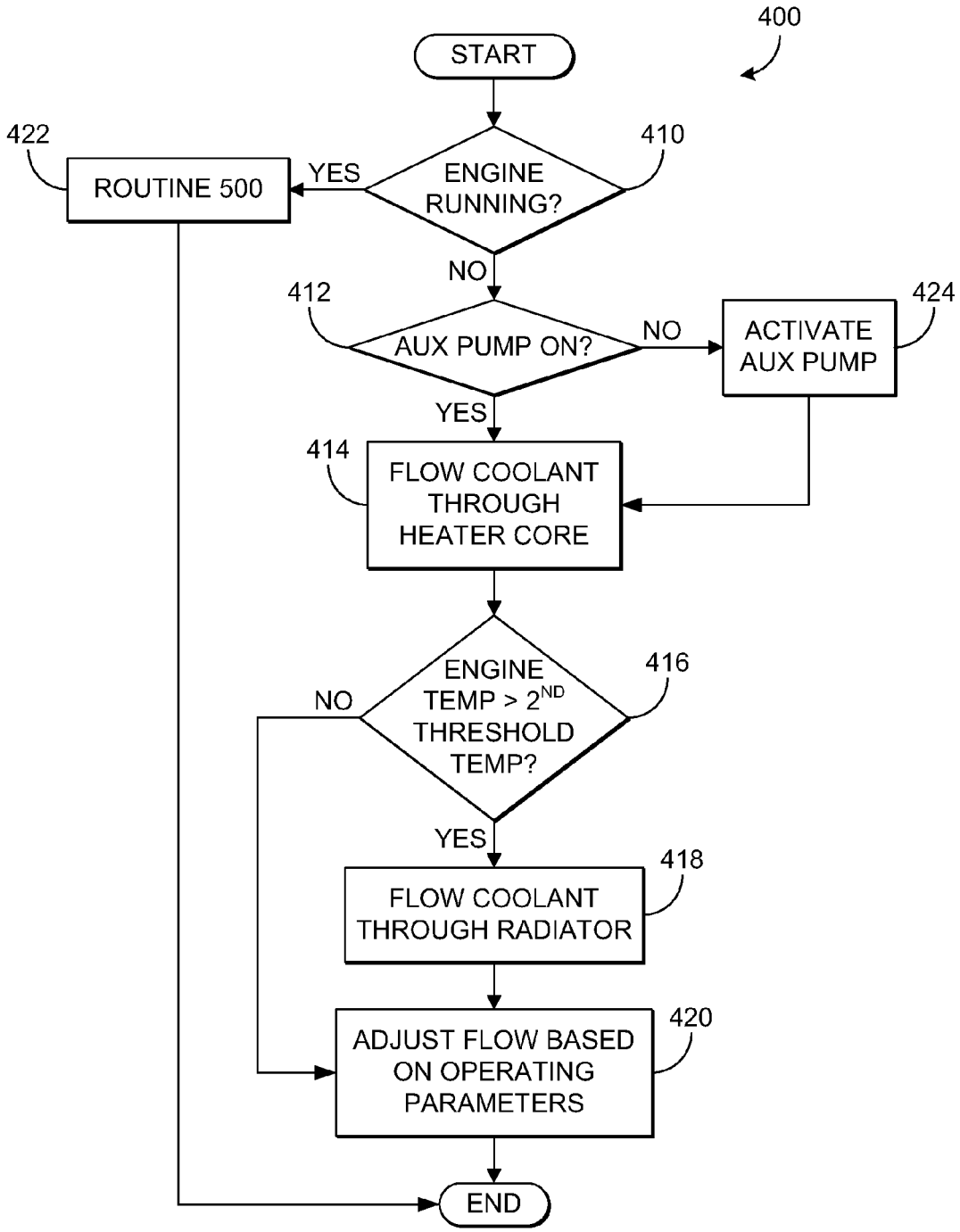
FIG. 4 shows a flow chart illustrating a routine for controlling the cooling system when the engine is off.

Control routines for operating an auxiliary pump in a cooling system will now be described with reference to FIGS. 4 and 5. The flow chart in FIG. 4 illustrates a control routine 400 for a cooling system, such as cooling system 200 depicted in FIG. 1, while the engine is off. Specifically, routine 400 determines a temperature of the engine and circulates coolant at least through the heater core based on the engine temperature. Further an amount of coolant flow may be adjusted based on operating parameters such as engine temperature and passenger compartment heat request.

At 410 of routine 400, it is determined if the engine is running. If it is determined that the engine is running, routine 400 moves to 422 where routine 500 is carried out and routine 400 ends. On the other hand, if it is determined that the engine is off, routine 400 proceeds to 412 where it is determined if the auxiliary pump is on. If the auxiliary pump is not on, the auxiliary pump is activated at 424 of routine 400. In a hybrid-electric vehicle, if the engine is shutdown and it is desired that the vehicle still be in operation (e.g., an electric only mode of operation), stored energy is used to power electronic components, such as the auxiliary pump. As such, the passenger compartment may be heated even while the engine is off.

In one example, a heater core fan airflow rate may be directly proportional to a rate of coolant flow through the heater core. In this manner, the heat supplied to the passenger compartment may be adjusted based on the speed of the auxiliary pump/heater core fan.

Once it is determined that the auxiliary pump is on or the auxiliary pump is activated, routine 400 of FIG. 4 continues to 414 where the auxiliary pump circulates coolant through the heater core. As coolant begins flowing through the heater core and back to the engine, it is determined if the engine temperature exceeds a first threshold temperature at 416 of routine 400. If it is determined that the engine temperature is not greater than a first threshold, routine 400 moves to 420 where the coolant flow is adjusted based on operating parameters such as passenger compartment heat request. For example, if a passenger in the vehicle (e.g., the driver) requests more heat in the passenger compartment, power to the auxiliary pump, and thus the coolant flow, may be increased.

On the other hand, if it is determined that the engine temperature is greater than the second threshold temperature, routine 400 of FIG. 4 proceeds to 418 where the coolant is circulated through the radiator in order to reduce and/or maintain the temperature of the engine. In some embodiments, as described above, flow to the radiator may be controlled via a thermostat valve, and, in this case, the thermostat valve may be opened to allow coolant flow through the radiator when the engine temperature increases above the second threshold temperature (e.g., via an electronically controlled thermostat, or via a mechanical thermostat). Once the auxiliary pump begins circulating coolant to the radiator, routine 400 proceeds to 420 where the flow is adjusted based on operating parameters. For example, if the engine temperature is increasing, coolant flow to the radiator may be increased by increasing operation (e.g., speed, pump capacity, etc.) of the auxiliary pump.

Thus, an auxiliary electric pump may be utilized to circulate coolant through the engine and to the heater core and/or a radiator while a hybrid-electric vehicle is operating in an electric only mode. Further, based on parameters such as the temperature of the engine and passenger compartment heat requests, the flow of coolant from the auxiliary pump may be adjusted. For example, when increased passenger compartment heat is requested, pump flow may be increased. Auxiliary pump operation may continue when the engine is on, as will be described below with reference to FIG. 5.

Figure 5:
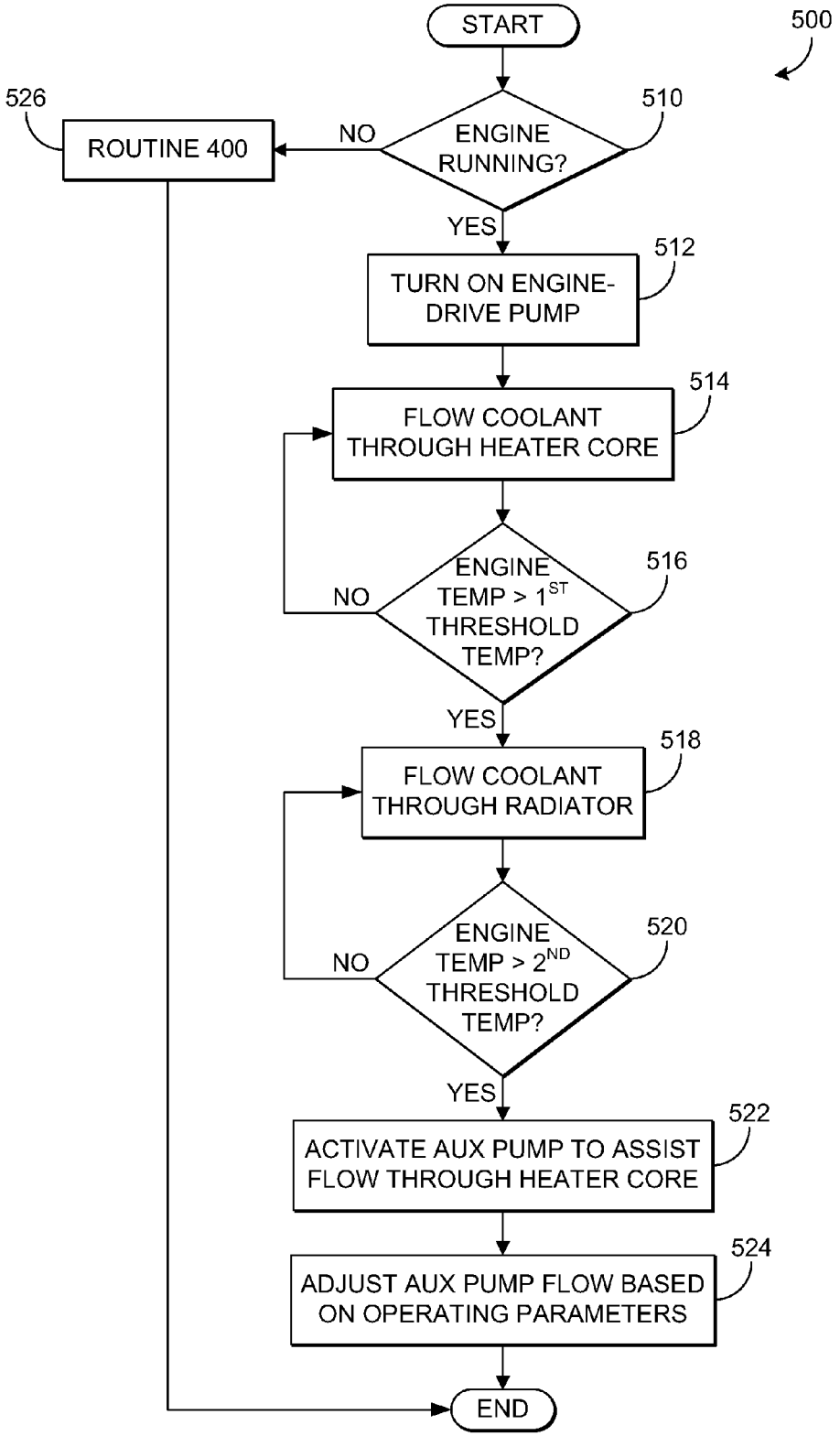
FIG. 5 shows a flow chart illustrating a routine for controlling the cooling system when the engine is running.

The flow chart in FIG. 5 shows a control routine 500 for a cooling system, such as cooling system 200 of FIG. 1, when the engine is running. Specifically, routine 500 controls coolant flow through an engine-driven pump and, during selected operating conditions, through an auxiliary pump to distribute heat from the engine to a radiator and/or a heater core.

At 510 of routine 500, it is determined if the engine is running. If it is determined that the engine is not running, routine 500 moves to 526 where routine 400 is carried out and routine 500 ends. When it is determined that the engine is running at 510, routine 500 continues to 512 where the engine-driven water pump is turned on. Once the engine-driven pump is turned on, routine 500 proceeds to 514 where coolant is circulated within the cooling system and through the heater core.

At 516 of routine 500 in FIG. 5, it is determined if the engine temperature is greater than a first threshold temperature. If it is determined that the engine temperature is less than the first threshold temperature, routine 500 returns to 514 where the engine-driven pump operates to circulate coolant through the heater core. On the other hand, if it is determined that the engine temperature is greater than the first threshold temperature, routine 500 proceeds to 518 and the engine-driven pump operates to pump coolant through the radiator in addition to the heater core.

Once coolant is flowing through the radiator, routine 500 determines if the engine temperature is greater than a second threshold value at 520. If the temperature is not greater than the second threshold value, routine 500 returns to 518 and the engine-driven pump continues to circulate coolant through the radiator and heater core. If it is determined that the engine temperature is greater than the second threshold value, routine 500 continues to 522 where an auxiliary water pump is activated to assist coolant flow through the heater core. In some embodiments, as described above, the auxiliary pump may assist the engine-driven pump in circulating coolant within the engine and EGR cooler in addition to the heater core.

After the auxiliary pump is activated, routine 500 proceeds to 514 where coolant flow from the auxiliary pump (e.g., amount of auxiliary pump assist) is adjusted based on various operating parameters and the auxiliary pump operates as a "smart" pump. As an example, the amount of auxiliary pump assist may be adjusted based on the vehicle speed, engine coolant temperature, ambient temperature, and/or combinations thereof. For example, as vehicle speed decreases, there may be less airflow through the radiator and the amount of auxiliary pump assist may increase in order to maintain the engine temperature, for example when the fan speed is already at a maximum speed. As another example, the amount of auxiliary pump assist may be adjusted in response to a change in ambient temperature (e.g., the temperature outside of the vehicle). In this case, as the ambient temperature increases, the amount of auxiliary pump assist may increase. As the ambient temperature rises, the amount of auxiliary pump assist increases in order to maintain the temperature of the engine as well as to maintain a lower amount of power to run the engine-driven pump.

Further still, auxiliary pump operation and fan speed may be coordinated to one another, and may further be coordinated with engine speed. As engine speed increases, for example, less auxiliary pump operation may be used, since the increased speed generates increased pump flow from the mechanical pump. Likewise, as fan speed decreases, auxiliary pump operation may be increased to compensate. Still other coordination between the fan and auxiliary pump operation may be used. Further still, other conditions may also be considered, such as an engine torque and/or power output level, where at high engine loads, even before coolant temperature rises, the auxiliary pump may be proactively engaged and operated at an increased level to reduce the rate of temperature rise, and thus prolong the ability to maintain high, or peak, engine loads, before engine torque and/or power limiting actions are taken. For example, if engine torque and/or power may be limited above selected coolant temperature thresholds, the system may anticipate such a conditions and thereby engage the auxiliary pump (or increase the auxiliary pump operation) when high engine loads are present, even when engine coolant temperature is below the upper threshold.

Thus, an auxiliary electric pump may be selectively utilized concurrently with an engine-driven pump. Additionally, the auxiliary pump may be adjusted (e.g., speed, pump capacity, etc.) to vary an amount of auxiliary pump assistance in response to various operating engine, vehicle, and passenger compartment heating, and cooling system operating parameters, such as vehicle speed and ambient temperature. By adjusting the power supplied to the auxiliary pump, and thus the amount of auxiliary pump assist, in one example, the amount of power for running the engine-driven pump may be decreased (and the engine-driven pump downsized) compared to a configuration in which the auxiliary pump does not assist the engine pump during high temperature engine operation.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A method for an engine cooling system with a radiator and a heater core, comprising:

during engine off, operating an auxiliary pump to flow coolant through the heater core;

during engine running, operating an engine-driven pump to flow coolant through the heater core and the radiator, and selectively operating the auxiliary pump to assist the flow through the heater core and radiator based on operating conditions; and during engine running, adjusting an auxiliary pump assist amount based on the operating conditions, wherein the operating conditions include engine speed, and in at least one condition the auxiliary pump assist amount increases when the engine speed decreases, and wherein the operating conditions include ambient temperature, and in at least one condition the auxiliary pump assist amount increases when the ambient temperature increases.

2. The method of claim 1, wherein an engine including the engine cooling system is coupled in a hybrid-electric propulsion system, and the auxiliary pump is an electric pump.

3. The method of claim 1, wherein selectively operating the auxiliary pump includes operating the auxiliary pump in response to engine coolant temperature being greater than a threshold temperature.

4. The method of claim 1, further comprising, during engine off, operating the auxiliary pump to flow coolant through the heater core and radiator.

5. A method for a cooling system coupled to a vehicle engine, comprising:

during engine off, operating an auxiliary pump to flow coolant through a heater core;

during engine running:

operating an engine-driven pump to flow coolant through the heater core and a radiator, selectively operating the auxiliary pump to assist the flow through the heater core and radiator based on ambient temperature, and decreasing an auxiliary pump assist amount based on decreasing ambient temperature.

6. The method of claim 5, wherein the vehicle has a hybrid-electric propulsion system, and where the auxiliary pump assist amount is further based on engine output.

7. The method of claim 5, wherein the auxiliary pump is an electric pump.

8. The method of claim 5, wherein selectively operating the auxiliary pump further includes activating the auxiliary pump when engine coolant temperature exceeds a threshold temperature.

9. The method of claim 5, wherein the auxiliary pump assist amount further decreases in response to an increase in engine speed.

10. A cooling system for an engine in a motor vehicle, comprising:

an engine-driven pump;

an auxiliary pump in fluidic communication with the engine-driven pump;

a first loop including a radiator, and where the engine-driven pump circulates coolant through the radiator in the first loop;

a second loop parallel to the first loop including a heater core, and where the auxiliary pump circulates coolant through the heater core in the second loop; and a controller for operating the auxiliary pump and the engine-driven pump, the controller comprising a computer readable storage medium, the medium comprising instructions for:

during engine off, operating the auxiliary pump to flow coolant through the heater core;

during engine running, operating the engine-driven pump to flow coolant through the heater core and the radiator, and selectively operating the auxiliary pump to assist the flow through the heater core based on operating conditions; and during engine running, adjusting an auxiliary pump assist amount based on the operating conditions, wherein the operating conditions include engine speed and ambient temperature, and, wherein the auxiliary pump assist amount increases in response to an increase in ambient temperature.

11. The system of claim 10, wherein the vehicle has a hybrid-electric propulsion system, and the auxiliary pump is an electric pump.

12. The system of claim 10, wherein the first loop includes a thermostat valve and the thermostat valve opens to allow coolant flow to the radiator after an engine temperature increases above a first threshold temperature.

13. The system of claim 10, wherein selectively operating the auxiliary pump includes turning the auxiliary pump on when engine coolant temperature increases above a second threshold temperature.

14. The system of claim 10, wherein the auxiliary pump assist amount decreases in response to an increase in engine speed.

15. The system of claim 10, further comprising a heater core fan, wherein a heater core fan airflow rate is directly proportional to a rate of coolant flow through the heater core.

* * * * *